US010087050B2

(12) United States Patent
Bisbee

(10) Patent No.: US 10,087,050 B2
(45) Date of Patent: Oct. 2, 2018

(54) CARRYING AID WITH NOOSE

(71) Applicant: Andrew Bisbee, Tigard, OR (US)

(72) Inventor: Andrew Bisbee, Tigard, OR (US)

(73) Assignee: Andrew James Bisbee, Beaverton, OR (US)

( * ) Notice: Subject to any disclaimer, the term of this patent is extended or adjusted under 35 U.S.C. 154(b) by 0 days.

(21) Appl. No.: 15/194,537

(22) Filed: Jun. 27, 2016

(65) Prior Publication Data

US 2017/0001844 A1 Jan. 5, 2017

Related U.S. Application Data

(60) Provisional application No. 62/188,375, filed on Jul. 2, 2015.

(30) Foreign Application Priority Data

Aug. 7, 2015 (GB) ..... 1513970.2
Dec. 30, 2015 (GB) ..... 1523080.8

(51) Int. Cl.
*B66C 1/18* (2006.01)

(52) U.S. Cl.
CPC ..... *B66C 1/18* (2013.01)

(58) Field of Classification Search
CPC ..... B66C 1/18
USPC ..... 294/29, 30, 27.1, 31.1, 33, 34, 74, 31.2, 294/150; 220/759; 248/318, 323
See application file for complete search history.

(56) References Cited

U.S. PATENT DOCUMENTS 215,344 A * 5/1879 Flynn
1,600,931 A * 9/1926 Chatham ..... A47G 7/047 248/318
1,839,636 A * 1/1932 Baker ..... B65D 23/104 294/164
2,080,148 A * 5/1937 Naysmith ..... B66C 1/14 294/74
2,090,979 A * 8/1937 Johansen ..... B65D 23/108 294/27.1
2,430,071 A * 11/1947 Mitchell ..... B66C 1/12 294/74
3,046,045 A * 7/1962 Campbell ..... B66C 1/12 182/1
4,000,922 A * 1/1977 Wade ..... B65G 7/12 294/113
4,022,507 A * 5/1977 Marino ..... B66C 1/18 294/150
4,305,584 A * 12/1981 Leehan ..... A63B 71/148 124/5
5,330,240 A * 7/1994 Barra ..... B66C 1/12 294/74
D361,934 S * 9/1995 Croteau ..... D9/434
6,062,520 A * 5/2000 Ralston ..... A47G 7/047 248/318

(Continued)

FOREIGN PATENT DOCUMENTS

GB 1513970.2 9/2015

*Primary Examiner* — Paul T Chin

(57) ABSTRACT

A carrying aid 10 with noose comprises a noose 12; a first pull element 14 extending from the noose 12, the first pull element 14 culminating in a first handle 16; and an opposing pull element 18 extending from the noose 12, the opposing pull element 18 culminating in an opposing handle 20; wherein the handles can be pulled to tighten the noose 12, without breaking the noose.

20 Claims, 4 Drawing Sheets

(56) References Cited

U.S. PATENT DOCUMENTS

| | | | | |
|---|---|---|---|---|
| 6,457,763 | B2 * | 10/2002 | Cornelius | A01M 31/00 294/153 |
| 7,118,149 | B1 * | 10/2006 | Mertz, Jr. | B65G 7/12 294/141 |
| 7,182,379 | B2 * | 2/2007 | Davis | A45F 3/14 294/152 |
| D613,077 | S * | 4/2010 | Markwardt | D6/315 |
| 9,271,485 | B2 * | 3/2016 | Estey | A01M 31/006 |
| 2006/0189456 | A1 | 8/2006 | Ford | |

* cited by examiner

CARRYING AID WITH NOOSE

The present invention relates to a carrying aid for helping to carry items, and is thought to be particularly useful for carrying carboys used for home brewing.

BACKGROUND

Home brewing of beer is becoming an increasingly popular pastime and now represents a significantly sized niche industry.

As part of the home brewing process, wort is stored in large containers, called carboys. Carboys tend to be able to hold gallons of wort (or any fluid), and therefore can become extremely heavy when filled anywhere near capacity. Therefore when it comes to having to move the carboy, the carboy may be extremely heavy, and may thus be challenging to move for the user. It goes without saying that picking up such an item may damage a user's back.

Several attempts have been made to offer carrying aids to users to help carry carboys. One proposed solution includes a harness-type belt system that is wrapped around the whole carboy. The belt system includes a top portion that can be held/gripped, so that the carboy can then be carried. However, the harness is toilsome to put onto the carboy, and the process of putting on/taking off the harness must be repeated each time the user wants to use the harness item to carry a different carboy. Furthermore certain materials, if used for the belt elements, may fail, for example, due to poor stitching.

Most of these proposed carrying aids do not correctly or helpfully balance the carboy centrally when carried (and/or balance load centrally), which can make the carboy more difficult to carry for the user, and increases chances of the carrying aid failing (ie breaking).

SUMMARY OF THE INVENTION

The present invention seeks to provide a solution to this problem(s), by providing: a carrying aid with noose, comprising: a noose; a first pull element extending from the noose, the first pull element culminating in a first handle; and an opposing pull element extending from the noose, the opposing pull element culminating in an opposing handle; wherein the handles can be pulled to tighten the noose.

The term 'carrying aid' is simply intended to mean 'a thing that helps carrying'. Whilst a primary aim/use of the invention is to aid in the carrying of carboys, it will be obvious that the invention is not limited to this, or any other use, and may be used to help carry any item under the Sun.

Intent is that a user can put the noose over a carboy neck (which tends to have ridge(s)), then pull the pull elements (preferably by pulling the handles) either side of the noose to tighten the noose round the neck of the carboy (eg under a ridge in the neck), and then pull upwards, thereby lifting (and carrying) the carboy.

In preferred embodiments, the carrying aid is designed in such way that the noose (which may also be referred to as a 'noose element') is always situated centrally between the handles and pull elements. This guarantees that the load of the carboy is evenly distributed between each side of the carrying aid, and therefore evenly distributed between the hands of the user carrying the carboy. This makes carrying easier for the user and makes failure (ie breaking) of the carrying aid less likely.

One of the added benefits of the invention (in preferred embodiments where the pull elements are of a significant length) is that the carboy need only be raised slightly above the ground when carried. This means that even if the carboy is dropped (which may be carrying gallons of wort), it is very unlikely the carboy will overturn and spill when it hits the ground, and instead may well simply fall on its flat base, thereby keeping the carboy upright.

Preferable and/or optional features of the invention are set forth in claims 2 to 19 inclusive.

BRIEF DESCRIPTION OF THE DRAWINGS

The present invention will now be more particularly described, with reference to the accompanying drawings, by way of example only and in no way limiting a scope of the invention, in which.

DETAILED DESCRIPTION

Figure 1:
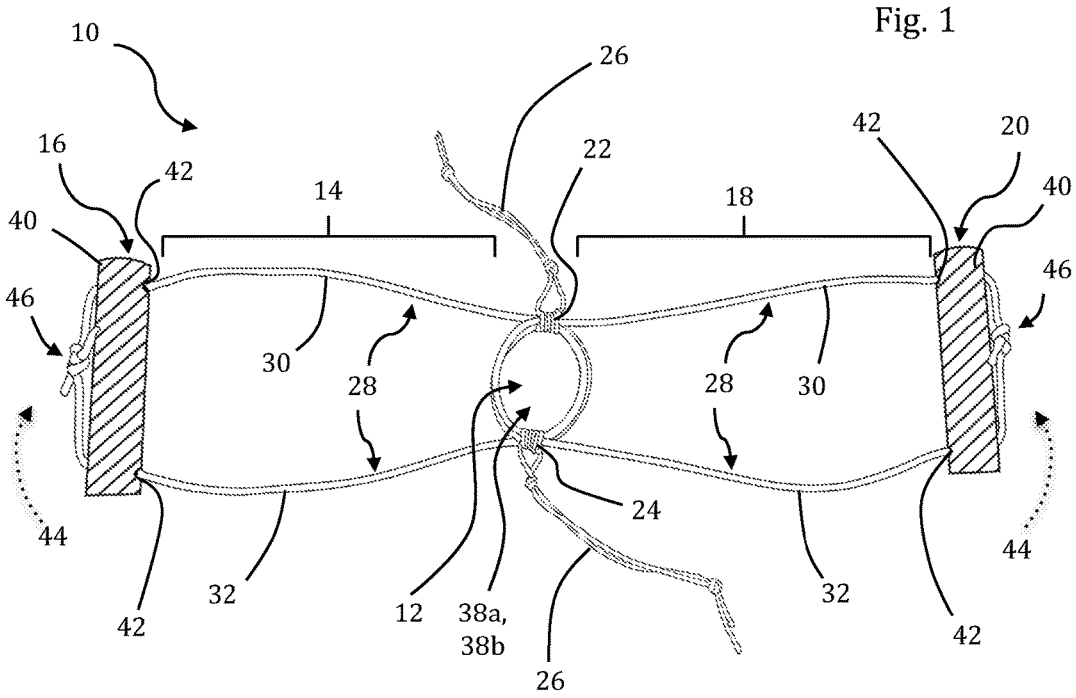
FIG. 1 is a top down view from above of one preferred embodiment of a carrying aid with noose, in accordance with the invention.

Referring to the drawings, there is shown a carrying aid 10 with noose, comprising: a noose 12; a first pull element 14 extending from the noose 12, the first pull element 14 culminating in a first handle 16; and an opposing pull element 18 extending from the noose, the opposing pull element 18 culminating in an opposing handle 20; wherein the handles can be pulled to tighten the noose 12.

(It should be understood that features such as pull elements 14, 18 and handles 16, 20 could be numbered interchangeably (ie that first pull element 14 could be seen as and/or defined as opposing pull element 18, and vice versa). Thus the first pull element 14 and first handle 16 could equally be seen as the opposing pull element 18 and opposing handle 20, if the opposing pull element 18 and opposing handle 20 are seen as the first pull element 14 and first handle 16. Such is the same for any other 'first' and 'opposing' elements featured).

Figure 4:
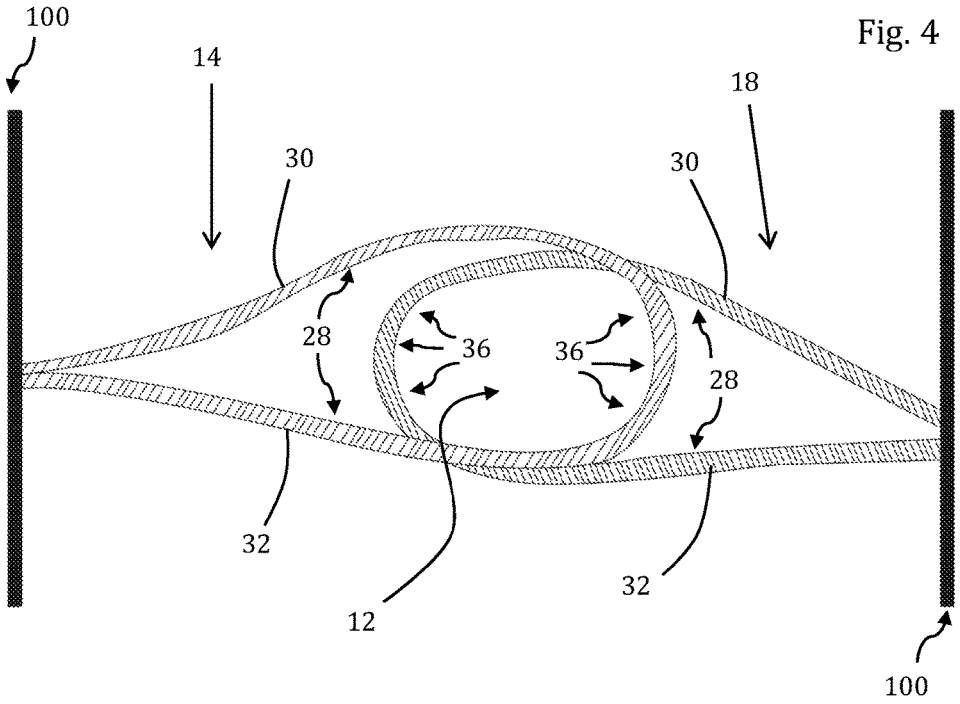
FIG. 4 is a close-up view of two cords overlapping to form a noose of the invention.
Figure 5:
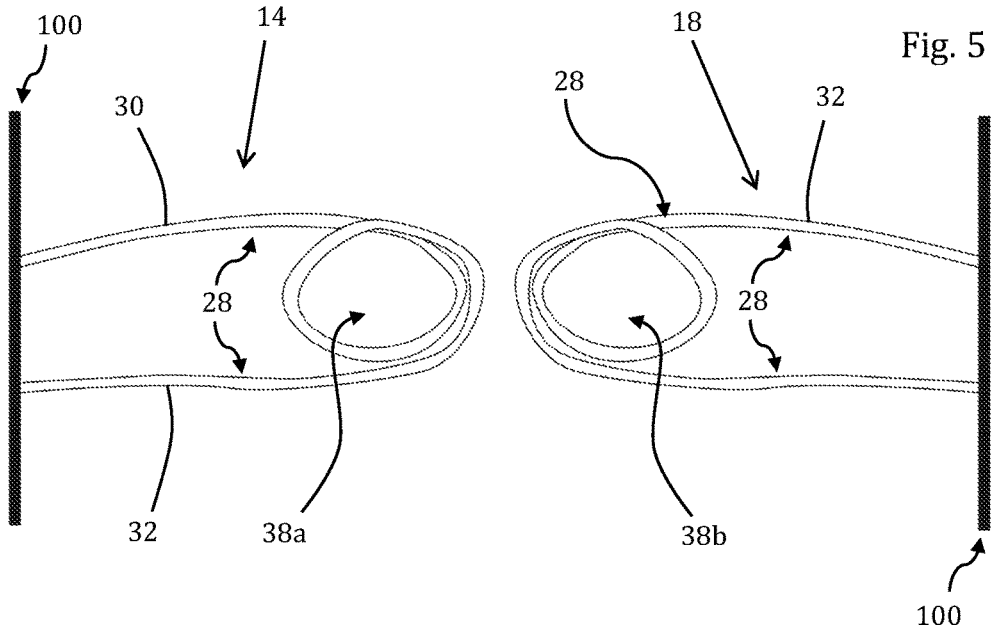
FIG. 5 is a close-up view of a preferred method/embodiment of forming the noose, wherein each of the two cords are looped, prior to being overlapped to form the noose.
Figure 6:
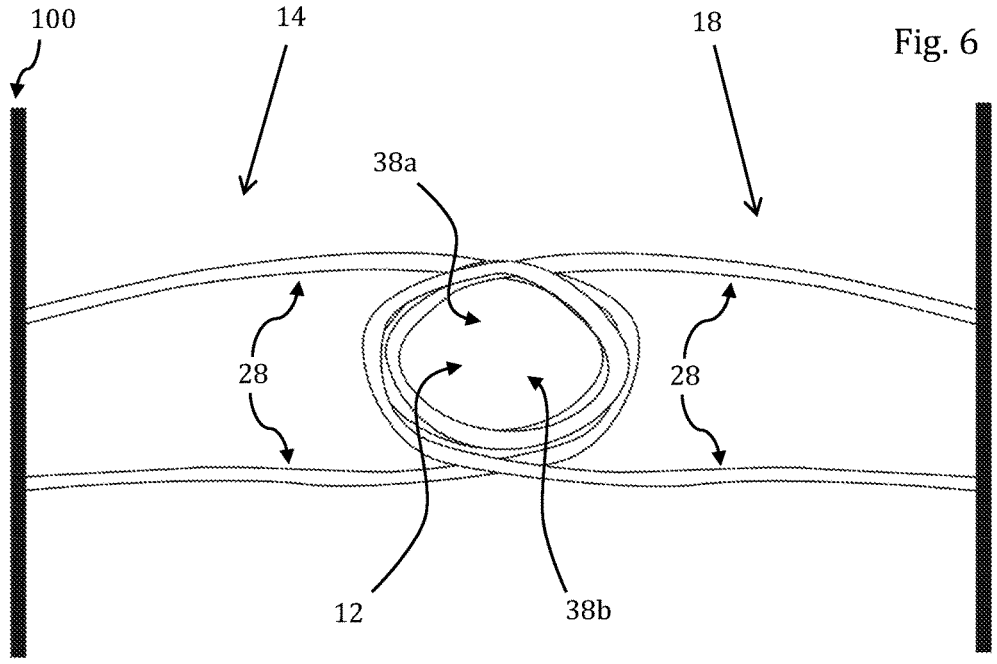
FIG. 6 is a close-up view of the cords shown in FIG. 5, now overlapped to form the noose.

Preferably there is provided a noose binding solution. In the shown example embodiments, the noose binding solution comprises a first noose binding element 22 on one side of the noose, and a second noose binding element 24 on an opposing side of the noose 12, although any noose binding solution under the Sun for binding the noose may be provided, not limited to comprising opposing noose binding elements 22, 24. The noose binding solution may, for example, in alternate embodiments, comprise solely one noose binding element. (The importance of the noose binding solution will become obvious when preferred embodiments for how to create the noose are shown in FIGS. 4, 5 and 6).

The noose binding elements 22, 24, in the shown preferred embodiments, are made of string (or any cord element), although are not limited to being made of string (or any cord element). In the example embodiments shown, the noose binding elements 22, 24 are wrapped round the noose 12, thus binding it together. A whipping knot (clearly shown wrapped round the noose 12 in FIGS. 1, 2, and 3) is used in the shown preferred embodiments to wrap the noose binding element round the noose, and bind it.

In the shown preferred embodiment of the noose binding element(s), the noose binding elements 22, 24 comprise an extending body 26, which in the shown example, is elongate. The extending body 26 can be used to untighten the noose 12 once the noose has been tightened round an object. (This can be achieved, for example, by pulling and/or wiggling and/or jiggling the extending body, thus tugging on the noose, which tends to loosen (and thus untighten) the noose). Thus in the shown preferred embodiment, there is provided a combined noose binding and noose untightening solution, whereby the noose binding elements comprise an extending body 26 that can be used to untighten the noose. It is also feasible that either a noose binding solution and/or a noose untightening solution may be provided, separate from one another. Thus there may be provided a noose binding solution and/or a noose untightening solution (not limited to the shown embodiments). The noose untightening solution is thus not limited to comprising an extending body 26. In embodiments wherein there is provided a combined noose binding and noose untightening solution, any noose binding element(s) are not limited to comprising an extending body 26 to facilitate untightening of the noose, and may comprise any solution (eg any body and/or element) to facilitate untightening of the noose 12.

In a preferred embodiment of the invention, as shown in all the Figures, the pull elements 14, 18 comprise (or are made up in their entirety out of) cord element(s) 28. The term 'cord element' 28 (which may be used interchangeably with the term 'cord' 28) is a broad term which includes within its scope any cord-type element, such as cord, cordage, string, wire, etc, or the such like element(s).

FIGS. 1, 2, 4, 5, 6 and 7 (all Figures except FIG. 3) show or allude to an embodiment of the invention wherein the pull elements are made up of cord element in their entirety. In preferred embodiments as such, the cord element preferably comprises a first cord portion 30 and a second cord portion 32. Preferably the first cord portion 30 and second cord portion 32 are formed from one cord element 28 (ie part of the same cord), although it is feasible that the or each pull element 14, 18 may comprise multiple (ie more than one) cord, and that the first and second cord portion may be formed from different cord elements of the same pull element.

Figure 3:
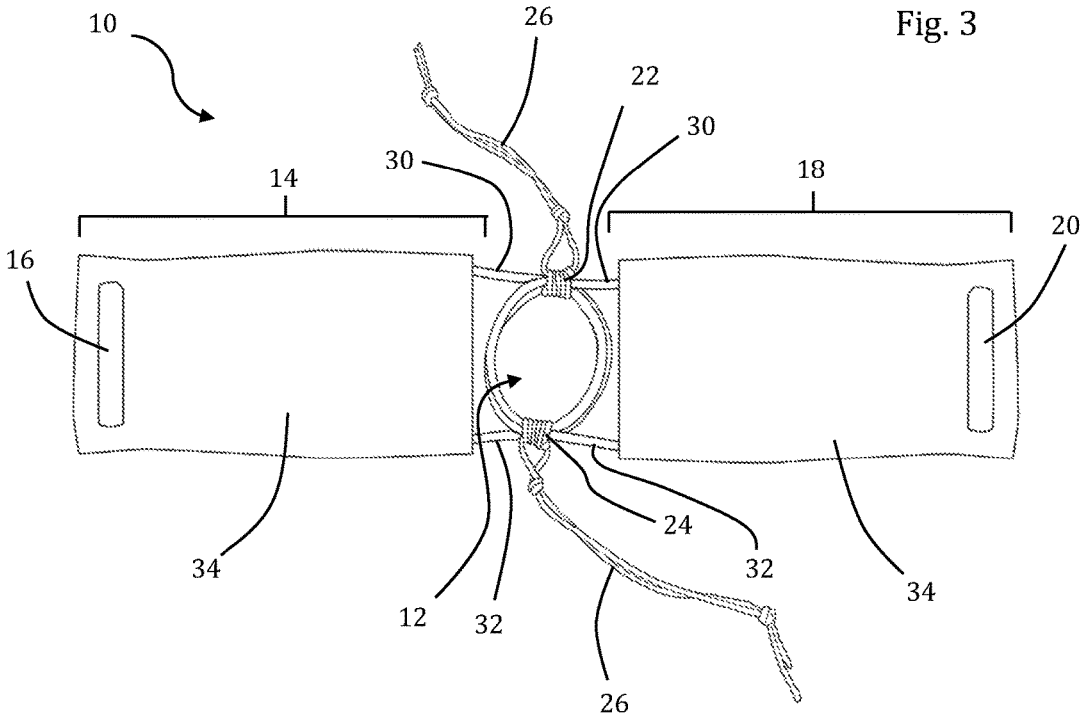
FIG. 3 is a top down view from above of an alternative embodiment of the invention, wherein pull elements of the carrying aid comprise a material body.

In FIG. 3, however, an embodiment is shown wherein the pull elements comprise a material body 34 (which could be made of any material and/or matter, and could, for example, comprise flexible material such as fabric). Nevertheless, as can be seen, the pull elements 14, 18, in the shown embodiment of FIG. 3, also comprise cord element(s), as they are shown comprising a portion (or a whole of) a first cord portion 30 and a second cord portion 32. The cord portions 30, 32, in such an embodiment, may be attached to the material body 34 in any way, such as but not limited to, stapling, fastening, etc, etc.

Thus the example embodiment shown in FIG. 3 shows an example embodiment of the invention, wherein the or each pull element comprises a plurality of portions of different constitution (eg, in the shown example, the pull element(s) comprises a material body and a cord portion(s)). Thus, in the shown example embodiment, the pull element comprises a plurality of portions of different constitution (inclusive, in the shown example, of a cord portion(s)), the cord portion(s) extending from the noose). The pull element (which, in the shown example embodiment, comprises the cord portion(s)), thus extends from the noose.

A preferred method of how to form the noose 12 is shown in FIGS. 4 to 6, wherein the pull elements 14, 18 each comprise a cord element 28, and the two cord elements are overlapped to form the noose 12.

(The noose forming method/element(s) are shown in close-up in FIGS. 4 to 6, thus the handles 16, 20 of the carrying aid 10 are not shown. Lines 100 are intended simply to denote the cut-off view of the carrying aid 10, such that not the whole of the carrying aid is shown in the FIGS. 4 to 6. Nevertheless, it should also be said that lines 100 are of a shape that resembles handles, and alternatively, if so desired, may feasibly be considered to be or resemble handles 16, 20).

In FIG. 4, the cord elements 28 of each pull element 14, 18 are shown overlapping to form the noose 12. The cord elements, in the shown embodiment, comprise a first cord portion 30, a second cord portion 32, and a looping cord portion 36 where the first and second cord portion loop round and meet. (It now becomes clear the usefulness of a noose binding solution for binding the noose when formed from two overlapped cord elements (eg as shown in FIG. 1).

However, such an embodiment as shown in FIG. 4 may not function extremely well in terms of the noose 12 tightening effectively when the pull elements 14, 18 are pulled. Thus, in a preferred embodiment, as shown in FIG. 5, each cord element is looped prior to overlapping. Thus, as shown in FIG. 5, cord element 28 of pull element 14 is looped over at its end to form a loop 38*a*, and cord element 28 of pull element 18 is also looped over at its end to form a loop 38*b*.

In FIG. 6, the same embodiment is shown as in FIG. 5, with the loops 38*a*, 38*b* now overlapped to form the noose 12. Thus the noose 12 now comprises a double-layered loop (rather than a single-layered loop as shown in FIG. 4). A double-layered loop as shown is far more effective in tightening round an object securely and tightly when the pull elements 14, 18 are pulled. (This same preferred method is utilized and shown in preferred embodiments of the noose 12 shown in FIGS. 1 to 3).

Figure 2:
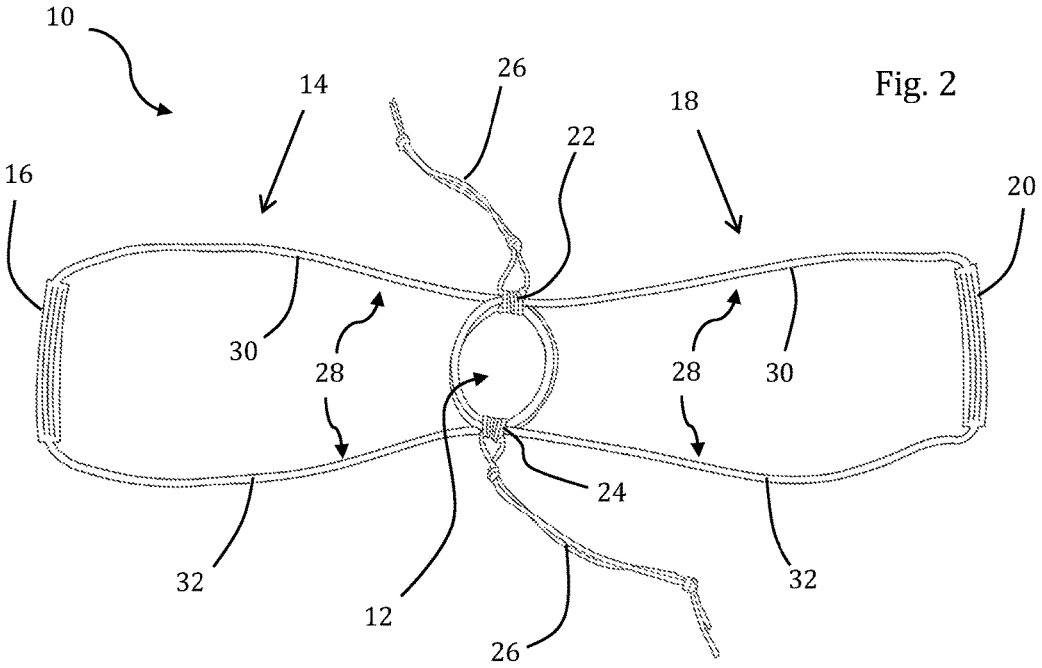
FIG. 2 is a top down view from above of a further embodiment of the invention, featuring alternative handles.

Thus preferred embodiments of the invention/noose, as shown, for example, in FIGS. 1 to 3, have a noose formed in such way as shown in FIGS. 5 and 6, wherein the noose 12 comprises a double-layered loop. It is feasible the noose 12 may comprise more than two layers of loops 34, with the cord elements of either or each pull element feasibly being looped multiple times before being overlapped to form the noose 12. Thus the noose 12, in said preferred embodiments, is said to comprise 'at least' a double-layered loop (ie two or more loops).

Thus in embodiments where the overlapping method is used to form the noose, preferably the first cord element forms part of or a whole of the first pull element 14, and the second cord element forms part of or a whole of the opposing pull element 18, the two cord elements overlapping to form the noose 12.

Referring to the handles 16, 20, the handles may be formed in any way. For example, the handles, in FIG. 3, are formed as openings (eg cut-out openings) in the material body 34. Referring to FIG. 2, an alternate embodiment of the handles 16, 20 is shown. In such an embodiment, it is feasible the handles 16, 20 are formed as part of the same element(s) as the pull elements 14, 18. Thus, for example, in the shown embodiment, wherein the pull elements comprise cord element, if the cord element is made out of, for example, elastic rubber (or any other mater and/or material), it is feasible that the handles 16, 20 as shown in FIG. 2 are formed via being, for example, machine-stamped, thus flattening and shaping the handles 16, 20, thus not requiring a separate handle member to the pull elements, but instead being formed of the same (ie feasibly the same piece of) cord element 28. The handles 16, 20 in FIG. 2 are shown shaped to facilitate easy handling and pulling of the pull elements by a user.

Figure 7:
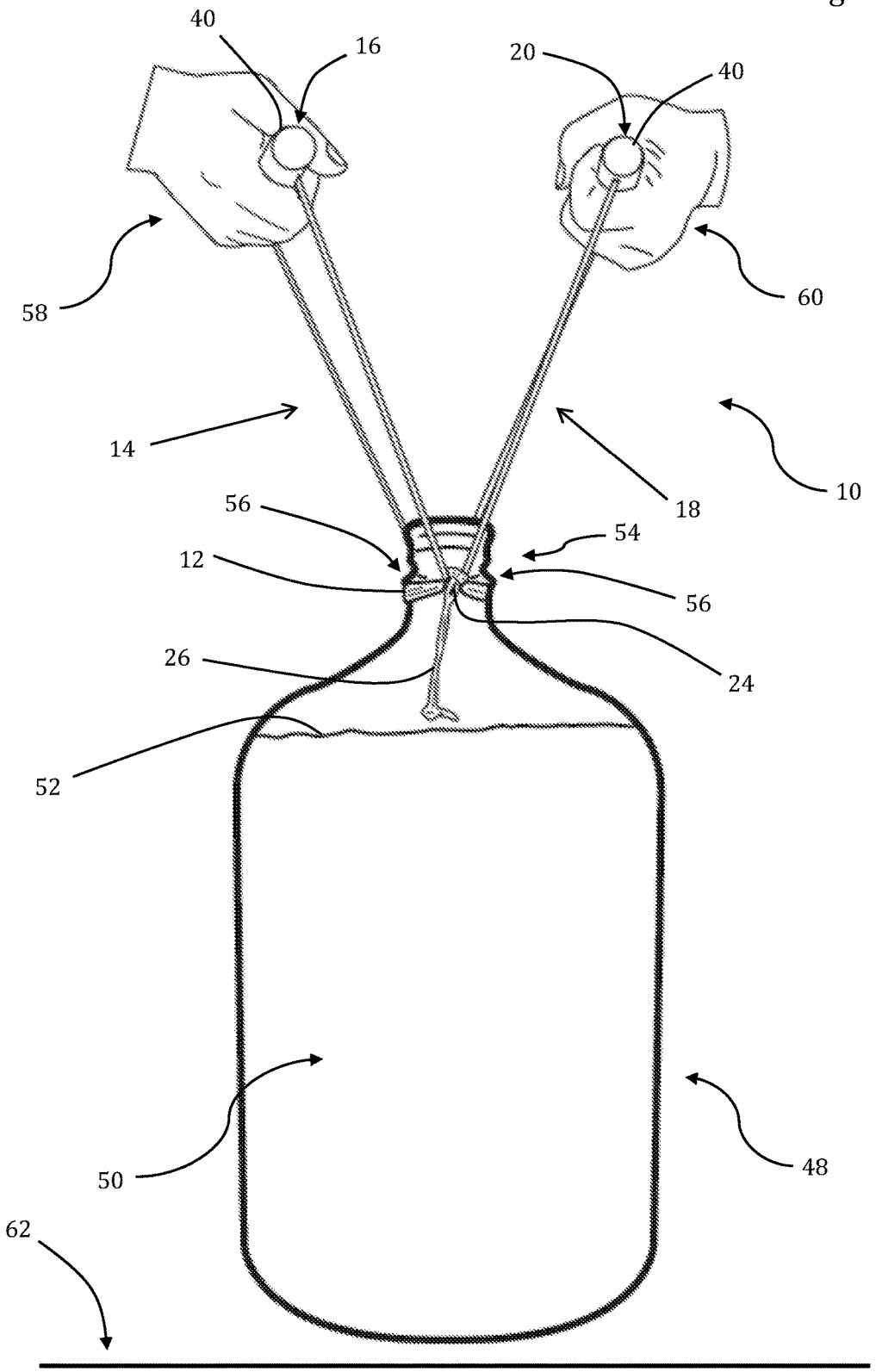
FIG. 7 shows the preferred embodiment of the invention as shown in FIG. 1, in use, helping a user carry a carboy.

However, in a preferred embodiment (shown clearly in the particularly preferred embodiment shown in FIG. 1, and also shown in FIG. 7, in use), the carrying aid 10 comprises separate handle members 40. The term 'separate handle members' is intended to imply that a separate member, separate to rest of the carrier aid, pull elements, etc, is used to form part of or a whole of the handles 16, 20. The separate handle members 40 shown in FIG. 1 and FIG. 7 are shown as cylindrical wooden handle members; however, the separate handle members 40 are not limited as such and may, for example, be any shape and/or dimension and made, for example, of any material/construction under the Sun, not at all limited to wooden and/or cylindrical members. For example, the separate handle members 40 may comprise (and/or be) a flexible padded member, which may, for example surround the cord element(s) of the pull elements, and may, for example, be attachable by Velcro®, the separate handle members thus comprising a flexible body and comprising Velcro® attachment means to attach them to the carrying aid 10. (The term 'Velcro®' is here intended to include within its scope any hook and loop, hook and hook, or loop and loop, or any attachment means considered in laymen's terms to be describable by the term 'Velcro®'). This is simply one example of a separate handle member 40, in no way limiting a scope of the term or invention. (As shown and/or stated, the separate handle members may comprise wood. As shown, the separate handle members may be wooden and/or may be cylindrical in shape).

It will be obvious that in a preferred embodiment, the pull elements each comprise cord element, and that in a still more preferred embodiment, the pull element are made out of cord element in their entirety. Thus, according to one preferred embodiment of the invention, preferably the separate handle members 40 each comprise at least one aperture (ie hole) through which the cord element(s) of the pull elements can be threaded. This is best shown in FIG. 1, where each separate handle member 40 comprises two apertures 42 (thus having at least one aperture) through which cord element 28 of the pull elements 14, 18 is threaded. The same cord element 28 then protrudes out of a reverse side of the separate handle members (ie a side faced away from the noose 12), through the aperture 42. (The reverse side is generally denoted by dashed arrow 44). The cord element 28 is then shown knotted on the reverse side 44 of the separate handle members 40, there being shown a knot 46. The first and second cord portions are thus preferably threaded through an aperture 42 in the separate handle member 40, and then tied together with a knot at the reverse side 44 of the separate handle member 40 once threaded through the apertures 42.

Apart from, in the shown embodiment, the knot functioning to secure the cord element and stop it from falling back out of the aperture(s) 42 of the separate handle member 40, the knot also functions as (and therefore is an embodiment of) a stopping element, stopping the noose 12 from wandering along the carrying aid/pull elements and thus changing position. To explain further, it will be known to those with skill in the art of such contraptions that a noose 12 of such a contraption has a tendency to wander along the carrying aid, changing position, and wandering from its central position. This is particularly true in embodiments such as that shown in FIG. 1 were the pull elements are made out of cord in their entirely. If the noose 12 wanders to a non-central position, it can lead to lessened effectiveness and efficiency in picking up objects with the carrying aid 10. For example, the noose 12 being non-central can lead to increased load being placed on one or the other side of the carrying aid 10 when an object is picked up. This can make it harder and more uncomfortable for a user to pick up an item, and can also increase likelihood of the carrying aid failing at point at which load and/or pressure is increased. Thus, in a preferred embodiment of the invention, the carrying aid comprises a noose centralizing solution, to keep the noose central on the carrying aid, and central with pull elements being of equal length on either side of the noose. The stopping element 46 (of which the knot 46 shown in FIG. 1 is simply one embodiment, in no way limiting the term 'stopping element' 46) is one method of achieving this; the stopping element 46 (shown as a knot) in FIG. 1 stops the cord element from passing back through the aperture(s) 42 of the separate handle members 40. Were there no stopping element 46, (eg if there were no stopping element 46, and instead there was just a continuation of cord, eg without knot), the cord could continually slide back through the aperture(s) 42, which in turn changes positioning of the noose 12, which inevitably may wander into a non-central position. Thus the stopping element is one solution for how to maintain the noose in a central position. With the knot embodiment as shown in FIG. 1, only a very small movement of the cord is possible back through the aperture(s) 42, until the knot blocks the movement (since it is larger in size than the aperture(s) 42 and thus stops the cord from sliding through).

The stopping element, in the example embodiment of FIG. 1, is provided at a reverse side 44 of each separate handle member. It is feasible, however, that a stopping element 46 may be provided at an alternate location of the carrying aid (ie any location), and nevertheless act as (and therefore is part of) a noose centralizing solution.

A knot, as shown in FIG. 1, is simply one embodiment of a stopping element 46. The stopping elements need not be formed as part of the cord element(s) and/or pull element(s)—eg it is feasible a separate element (not part of the cord element(s) and/or pull element(s)) is provided as a stopping element, which in some way prevents sliding/wandering of the noose from a central position, preferably by restricting sliding of cord element(s) of the pull elements 14, 18.

In Use

The invention will now be described in use, referring to a preferred embodiment of the invention, and in no way limiting a scope of the invention, and referring particularly to FIG. 7, where the invention is shown to facilitate carrying of a carboy. Thus, in use, (not limiting the invention), a carboy 48 is shown. The carboy is shown almost full of wort 50 (or any fluid). A fill level 52 of the carboy 48 shows that the carboy is almost full of fluid and may weigh several or more gallons. The carboy is shown having a neck 54, the neck 54 comprising several ridges. There is shown a prominent ridge 56, under which the noose 12 has been placed. The pull elements 14, 18 have been pulled to tighten the noose round the neck of the carboy, underneath the prominent ridge 56. The prominent ridge 56 thus helps secure the noose 12, tightened underneath the prominent ridge 56.

A user's hands (right hand 58 and left hand 60) are shown gripping the preferred separate handle members 40. The act of lifting the carboy 48 (or any object) may thus further tighten the noose 12. The carboy is shown being lifted up from the floor 62. Even if the carboy is dropped, it may well land safely on the floor and stay upright (not spilling) since the invention, in preferred embodiments as shown (where the pull elements are of a good or significant length) allows the carboy to be lifted only slightly off the ground 62, to be carried, and at an angle where it may well land on its flat underside if it is dropped.

The extending body 26 of the noose binding solution (and/or noose binding element(s)) is shown dangling—once the carboy has been carried to its desired location, it may be possible to pull on the extending body 26 to loosen the noose 12 from the neck 54 of the carboy 48. Thus the carrying aid can be easily applied to a carboy, and removed, in seconds, perhaps then to be quickly used on another carboy (or any object).

The embodiments described above are provided by way of example only, and various other modifications will be apparent to persons skilled in the art without departing from the scope of the invention as defined in the appended claims.

The invention claimed is:

1. A carrying aid with noose, comprising:

a noose;

a first pull element extending from the noose, the first pull element culminating in the first handle; and an opposing pull element extending from the noose, the opposing pull element culminating in an opposing handle;

wherein the handles can be pulled to tighten the noose, the carrying aid further comprising a noose untightening solution, comprising an arrangement operable by a user to facilitate untightening the noose, without breaking the noose.

2. A carrying aid with noose as claimed in claim 1, wherein the noose untightening arrangement comprises an extending body to facilitate untightening of the noose.

3. A carrying aid with noose as claimed in claim 2, wherein the extending body extends from a noose binding element.

4. A carrying aid with noose as claimed in claim 1, wherein the noose untightening arrangement comprises:

a first extending body extending from a first side of the noose; and a second extending body extending from an opposing side of the noose.

5. A carrying aid with noose as claimed in claim 4, wherein the first extending body extends from a first noose binding element on the first side of the noose, and the second extending body extends from a second noose binding element on the opposing side of the noose.

6. A carrying aid with noose as claimed in claim 1, wherein there is provided a noose binding solution.

7. A carrying aid with noose as claimed in claim 6, wherein the noose binding solution comprises a noose binding element, the noose binding element in turn comprising a body to facilitate untightening of the noose, the noose untightening arrangement thus comprising the body.

8. A carrying aid with noose as claimed in claim 7, wherein the body is an extending body.

9. A carrying aid with noose as claimed in claim 6, wherein the noose binding solution comprises a first noose binding element on a first side of the noose, and a second noose binding element on an opposing side of the noose, each of the noose binding elements comprising a body to facilitate untightening of the noose, the noose untightening arrangement thus comprising the bodies.

10. A carrying aid with noose as claimed in claim 9, wherein each of the bodies is an extending body.

11. A carrying aid with noose, comprising:

a noose;

a first pull element extending from the noose, the first pull element culminating in a first handle; and an opposing pull element extending from the noose, the opposing pull element culminating in an opposing handle;

wherein the handles can be pulled to tighten the noose;

the carrying aid further comprising a noose centralizing arrangement outside of the noose, to maintain the noose in a centralized position.

12. A carrying aid with noose as claimed in claim 11, wherein the noose centralizing arrangement comprises a stopping element, to prevent excessive sliding of said pull element, thus maintaining the noose in a centralized position.

13. A carrying aid with noose as claimed in claim 12, wherein said pull element comprise a said stopping element.

14. A carrying aid with noose as claimed in claim 13, wherein said pull element comprise cord element, the said stopping element provided by way of a knot being tied in the cord element.

15. A carrying aid with noose as claimed in claim 14, wherein the cord element of said pull element comprises a first cord portion and a second cord portion, and the knot is provided by way of the first cord portion and the second cord portion being tied together.

16. A carrying aid with noose as claimed in claim 15, wherein the handles of the carrying aid each comprise a separate handle member, the handle members each comprising:

an aperture for a said first cord portion to pass through; and an aperture for a said second cord portion to pass through.

17. A carrying aid with noose as claimed in claim 16, wherein the first cord portion and second cord portion of the pull elements are tied once passed through the apertures, to form the knot, and thus to form the stopping element.

18. A carrying aid with noose as claimed in claim 12, wherein the handles each comprise a separate handle member, the separate handle member comprising an aperture through which the pull element can be passed through, there being provided said stopping element to prevent the pull element from sliding back through the aperture.

19. A carrying aid with noose as claimed in claim 18, wherein the pull elements each comprise a first cord portion and a second cord portion, and wherein the separate handle member is further defined as comprising an aperture for said first cord portion to be passed through, and an aperture for said second cord portion to be passed through, said stopping element thus provided to prevent the cord portions from sliding back through the apertures.

20. A carrying aid with noose as claimed in claim 19, wherein the stopping element is provided by way f the first and second cord portions being tied together as a knot.

* * * * *